United States Patent [19]

Fueslein

[11] 4,021,868

[45] May 10, 1977

[54] CONTOUR HAMMOCK

[76] Inventor: Jerome L. Fueslein, 6801 E. Highway 4, Stockton, Calif. 95206

[22] Filed: Nov. 7, 1975

[21] Appl. No.: 629,825

[52] U.S. Cl. ..... 5/123; 5/127
[51] Int. Cl.[2] ..... A45F 3/22
[58] Field of Search ..... 5/120–130; 297/45, 282, 276, 777, 441, 284

[56] References Cited

UNITED STATES PATENTS

| | | | |
|---|---|---|---|
| 363,096 | 5/1887 | Travers | 5/123 |
| 2,827,949 | 3/1958 | Kershaw | 5/120 |

FOREIGN PATENTS OR APPLICATIONS

| | | | |
|---|---|---|---|
| 63,943 | 9/1941 | Norway | 5/120 |
| 638,548 | 6/1950 | United Kingdom | 5/122 |
| 462,955 | 3/1937 | United Kingdom | 5/123 |

*Primary Examiner*—Casmir A. Nunberg

[57] ABSTRACT

A contour hammock having a fabric hammock sheet stretched transversely between two longitudinal lines. The two longitudinal lines are spaced apart in the central area by a plurality of transverse spreader members. The spreader members are suspended beneath the hammock sheet and are suitably curved to avoid contacting the occupant of the hammock. The spreader members are preferably disposed at spaced locations defining transversely taut regions corresponding to the concavities of the occupant.

10 Claims, 6 Drawing Figures

CONTOUR HAMMOCK

This invention relates to hammocks, and more particularly, to a contour hammock adapted to conform to the body shape of the occupant.

Conventionl hammocks generally define a hammock surface stretched longitudinally by two or more support lines or ropes. Since the hammock surface is under substantial longitudinal tension, it cannot readily conform to occupant's body shape. Rather, a conventional hammock assumes a generally parabolic shape to which the occupant must conform.

The hammock surface of a conventional hammock is generally slack in the transverse direction, resulting in a tendency to wrap around and envelope the occupant. To minimize this effect, transverse spreader members are often provided adjacent the ends of the hammock. While this construction is somewhat improved adjacent the ends of the hammock, such hammocks still tend to deform excessively in the central area. Moreover, the longitudinal curvature of the hammock is substantially uneffected, and the stability of the hammock is decreased.

The foregoing drawbacks of conventional hammocks render their use generally acceptable only for occupancies of short duration, the discomfort resulting from prolonged use being generally unacceptable.

Accordingly, it is in an object of the present invention to provide a contour hammock which supports the occupant in a generally level position, suitable for sleeping.

Another object of the present invention is to provide a contour hammock that will conform to the body shape of the occupant, providing support adjacent the occupant's concavities.

Still another object of the present invention is to provide a contour hammock which is sufficiently comfortable for prolonged use.

To these ends, there is provided a contour hammock according to the present invention having a fabric hammock sheet carried between two longitudinal lines. The hammock sheet preferably includes tubular hems along the longitudinal edges through which the longitudinal lines respectively pass. The hammock sheet is free to slide on the longitudinal lines, to minimize longitudinal tension in the sheet.

The two longitudinal lines are spaced apart in the central area by a plurality of transverse spreader members. The spreader members are suspended beneath the hammock sheet and are suitably curved to avoid contacting the occupant of the hammock. The spreader members are preferably disposed at spaced locations defining transversely taut regions corresponding to the concavities of the occupant. Specifically, three spreader members are preferably provided generally ajacent the neck, lower back and knee regions of the occupant.

Since the tension created by the weight of the occupant is primarily transversely directed, there is little tendency for the hammock to bow longitudinally. Rather, the occupant is supported in generally level position. Moreover, the transverse tension is concentrated adjacent the spreader members, providing needed support for the concave regions of the occupant. As a result of the foregoing, a significant improvement in occupant comfort is noted in comparison to conventional hammocks.

These and other objects, features and advantages of the present invention will be more readily apparent from the following detailed description of the preferred embodiment of the present invention, wherein reference is made to the accompanying drawings, in which.

Figure 1:
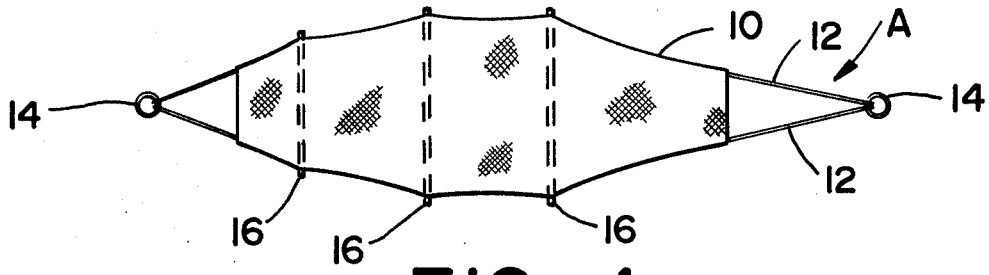
FIG. 1 is a plan view of a contour hammock according to the preferred embodiment of the present invention.
Figure 2:
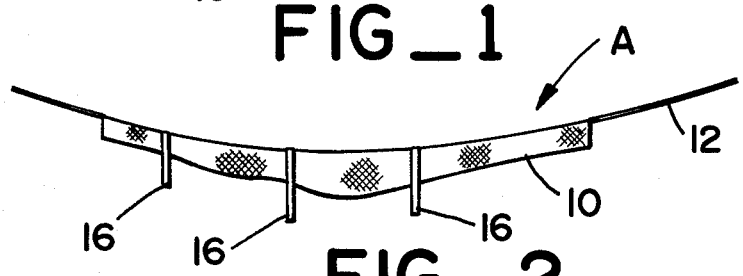
FIG. 2 is a side elevation of the contour hammock of FIG. 1.
Figure 3:
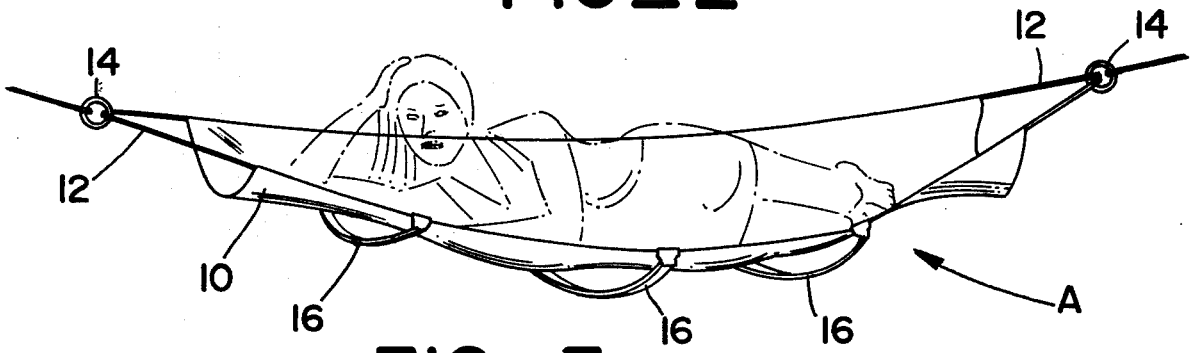
FIG. 3 is a perspective view of the contour hammock of FIG. 1, with an occupant illustrated in phantom line.

Referring initially to FIGS. 1–4, the contour hammock according to the preferred embodiment of the present invention will now be described in detail. Contour hammock A generally comprises a fabric hammock sheet 10 stretched transversely between two longitudinal lines or ropes 12. Longitudinal lines 12 preferably terminate at two or more rings 14 suitable for attachment of support lines.

In the preferred embodiment depicted in the drawings, one ring 14 is provided at each end of the hammock A with the longitudinal lines 12 attached in common, to provide a two point suspension hammock. Alternatively, separate support lines may be provided for each of the longitudinal lines 12, at one or both ends, to form three point or four point suspension hammocks, as desired. The contour hammock A according to the present invention has been found to be sufficiently stable with the two point suspension depicted in the drawings, so as to render the provision of the additional support lines generally unnecessary.

Figure 6:
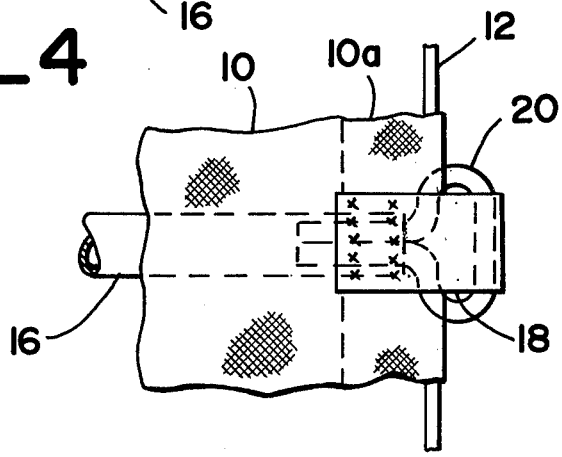
FIG. 6 is a plan view of the region of the contour hammock depicted in FIG. 5.

As best seen in FIG. 6, the longitudinal edges of the hammock sheet 10 are preferably folded and sewn to define tubular longitudinal hems **10*a*, through which the longitudinal lines 12 pass. The tubular hems 10*a* are free to slide on the longitudinal lines 12. As will be more readily apparent hereinafter, the longitudinal tension of the hammock sheet 10** is thus minimized.

Figure 4:
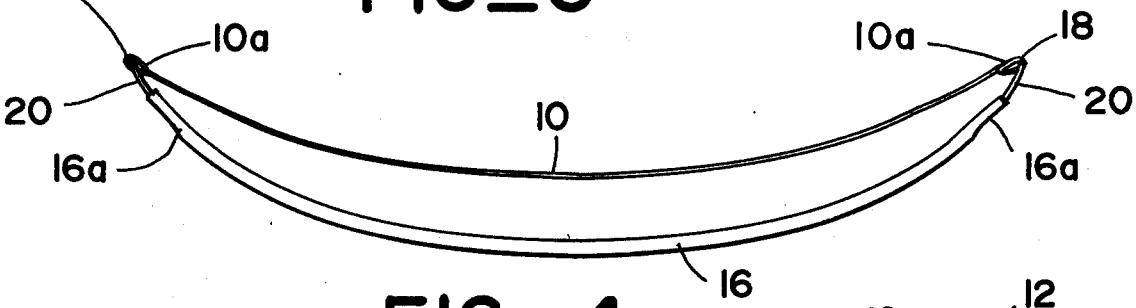
FIG. 4 is a cross-sectional view of the contour hammock of FIG. 1, taken adjacent one of the spreader members 16.

The longitudinal lines 12 are spaced apart in the central area of the hammock by a plurality of transverse spreader members 16. Spreader members 16 are suspended beneath the hammock sheet 10 and are suitably shaped to avoid contacting the occupant of the hammock. A preferable configuration for the spreader members 16 is best shown in FIG. 4, wherein an arched spreader member 16 is depicted. The spreader members 16 are sufficiently curved and are sufficiently longer than the width of the hammock sheet 10 adjacent the respective spreader members 16, to prevent contact between the hammock sheet and the spreader member.

The spreader members 16 are preferably disposed at spaced locations corresponding to the concavities of the occupant. Thus, three spreader members 16 are preferably provided at the neck, lower back and knee regions of the occupant, respectively. The weight of the occupant will tend to create substantial transverse tension in the hammock sheet 10, and such tension will be concentrated adjacent the spreader members 16. Thus, three relatively taut regions are established, tending to support the concavities or hollows of the occupant. Conversely, the hammock sheet 10 is free to deform at the regions remote from the spreader members 16 causing the hammock sheet 10 to conform to the occupant's shape.

Thus, while the longitudinal tension created in the longitudinal lines 12 will cause the lines to assume a generally parabolic shape, the hammock sheet 10 will nonetheless assume a body contour shape. By appropriately dimensioning the width of the hammock sheet 10, a generally level position may be established for the occupant.

Specifically, increasing the width of the hammock sheet 10 adjacent the ends will tend to lower the position of the head and feet of the occupant, and thereby eliminate the conventional parabolic shape. Similarly, the degree of support provided adjacent the spreader members 16 is determined by the width of the hammock sheet 10 relative to the spreader member 16, at the corresponding locations. Decreasing the width of the hammock sheet 10 adjacent a spreader member 16 will reduce the ability of the hammock sheet to deform in this region, resulting in an increase in the support provided. Of course, the straight line distance between the ends of the spreader member 16 defines a lower limit for the width of the hammock sheet 10 at the corresponding location.

Figure 5:
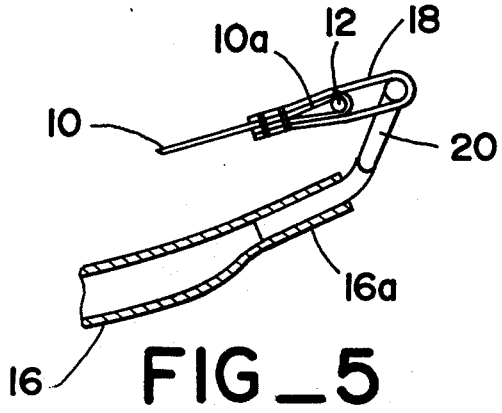
FIG. 5 is an enlargement of a portion of FIG. 4, illustrating the attachment of the spreader members to the hammock sheet.

Referring now to FIGS. 5 and 6, the attachment of the hammock sheet 10 to the spreader member 16 will now be described in detail. To this end, a plurality of attachment loops 18 are preferably sewn onto the fabric sheet 10 at the desired attachment points. Attachment loops 18 pass through rings 20 which, in turn, are attached to the ends of the spreader members 16. Specifically, spreader members 16 are preferably hollow, and the ends 16a thereof are swaged or crimped onto the rings 20, as depicted in FIGS. 5 and 6.

While a variety of materials may be employed to construct the contour hammock A according to the present invention, certain materials are preferably employed according to the preferred embodiment, providing a contour hammock of substantial strength and durability.

Specifically, the hamamock sheet 10 preferably comprises nylon fabric. The spreader members 16 may comprise structural steel tubing, enameled to minimize corrosion. One quarter inch braided polyester rope may be employed for the longitudinal lines 12 and the suspension lines. Attachment loops 18 preferably comprise strips of fabric webbing. Rings 14 and 20 are preferably formed of steel rod.

While a particular embodiment of the present invention has been shown and described in detail, it is apparent that adaptations and modifications may occur to those skilled in the art. For example, the hammock sheet may be formed integral with a sleeping bag, to form a combined hammock-sleeping bag particularly useful for outdoor sleeping. It is to be expressly understood that such adaptations and modifications are within the spirit and scope of the present invention, as set forth in the claims.

What is claimed is:

1. A contour hammock comprising a pair of flexible longitudinal lines, a hammock sheet carried solely between said longitudinal lines, said hammock sheet being longitudinally slideable relative to said longitudinal lines to minimize longitudinal tensioning of said hammock sheet and spreader means for maintaining said longitudinal lines in spaced apart relationship in the central area of said hammock sheet to transversely tension said hammock sheet under load.

2. Apparatus according to claim 1 wherein said spreader means comprises a plurality of transverse spreader members disposed at spaced locations in the central area of said hammock sheet.

3. Apparatus according to claim 2 wherein said spreader members are suspended beneath said hammock sheet and are suitably curved to avoid contacting said hammock sheet under load.

4. Apparatus according to claim 2 wherein said plurality of spreader members comprises three spreader members disposed adjacent the neck, lower back and knee regions of the occupant, respectively.

5. Apparatus according to claim 1 wherein said hammock sheet comprises tubular hems along the longitudinal edges thereof, said longitudinal lines passing therethrough.

6. Apparatus according to claim 1 wherein the width of said hammock sheet adjacent the ends thereof is sufficient to suspend the head and feet of the occupant generally level relative to the central portion of the hammock sheet under load.

7. Apparatus according to claim 1 comprising a pair of rings, the corresponding ends of both of said longitudinal lines being attached in common to each of said rings to define two suspension points.

8. A contour hammock comprising a pair of flexible longitudinal lines, a hammock sheet carried solely between said longitudinal lines, said hammock sheet having tubular hems along the longitudinal edges thereof with said longitudinal lines slidably passing therethrough to minimize longitudinal tensioning of said hammock sheet, and a plurality of transverse spreader members suspended beneath said hammock sheet between said longitudinal lines at spaced locations in the central area of said hammock sheet to transversely tension said hammock sheet under load.

9. Apparatus according to claim 8 wherein said plurality of spreader members comprises three spreader members disposed adjacent the neck, lower back and knee regions of the occupant, respectively.

10. Apparatus according to claim 8 wherein the width of said hammock sheet adjacent the ends thereof is sufficient to suspend the head and feet of the occupant generally level relative to the central portion of the hammock sheet under load.

* * * * *